US011739615B2

(12) United States Patent
Bolivar et al.

(10) Patent No.: US 11,739,615 B2
(45) Date of Patent: Aug. 29, 2023

(54) SINGLE TRIP LINER HANGER SYSTEM

(71) Applicant: Packers Plus Energy Services Inc., Calgary (CA)

(72) Inventors: Javier Bolivar, Tomball, TX (US); Brian Fredericks, Tomball, TX (US)

(73) Assignee: Packers Plus Energy Services Inc., Calgary (CA)

( * ) Notice: Subject to any disclaimer, the term of this patent is extended or adjusted under 35 U.S.C. 154(b) by 0 days.

(21) Appl. No.: 17/208,746

(22) Filed: Mar. 22, 2021

(65) Prior Publication Data

US 2021/0293117 A1 Sep. 23, 2021

Related U.S. Application Data

(60) Provisional application No. 62/993,626, filed on Mar. 23, 2020.

(51) Int. Cl.

| | |
|---|---|
| ***E21B 43/10*** | (2006.01) |
| ***E21B 23/06*** | (2006.01) |
| ***E21B 17/02*** | (2006.01) |
| ***E21B 17/042*** | (2006.01) |
| ***E21B 23/01*** | (2006.01) |
| ***E21B 33/12*** | (2006.01) |

(52) U.S. Cl.

CPC ..... *E21B 43/105* (2013.01); *E21B 17/021* (2013.01); *E21B 17/042* (2013.01); *E21B 23/01* (2013.01); *E21B 23/06* (2013.01); *E21B 43/10* (2013.01); *E21B 43/106* (2013.01); *E21B 33/12* (2013.01)

(58) Field of Classification Search

CPC .... E21B 43/105; E21B 17/021; E21B 17/042; E21B 23/01; E21B 23/06; E21B 43/10; E21B 43/106; E21B 33/12

See application file for complete search history.

(56) References Cited

U.S. PATENT DOCUMENTS

| | | | | |
|---|---|---|---|---|
| 2,979,132 | A * | 4/1961 | Taylor | E21B 33/1291 166/138 |
| 4,681,159 | A * | 7/1987 | Allwin | E21B 43/10 166/124 |
| 10,662,762 | B2 * | 5/2020 | Alnughaimish | E21B 47/117 |
| 2010/0236781 | A1 * | 9/2010 | Mytopher | E21B 43/119 166/55 |

(Continued)

*Primary Examiner* — Jonathan Malikasim

(74) *Attorney, Agent, or Firm* — Prince Lobel Tye LLP

(57) ABSTRACT

A liner hanger system enables installation of a liner hanger by means of a full bore casing to surface and provides pressure integrity between the casing's inner and outer sides. The liner hanger system comprises a liner hanger, along with an associated liner, coupled to a tieback casing string. The liner hanger and liner are deployed downhole connected to a tieback casing string. Once the liner has been lowered to the position of interest, first the liner hanger is anchored and cemented in position, and then, a packer is set to seal the lower annulus of the liner. The liner hanger system enables operations that used to require a plurality of trips, to be performed in a single trip. It does so without introducing any unwanted limitation to the inner diameter at any point between the wellhead and the end of the liner, and while also allowing for potential decoupling and removal of the tieback casing string from the liner hanger if desired.

19 Claims, 7 Drawing Sheets

(56) References Cited

U.S. PATENT DOCUMENTS

| | | | | |
|---|---|---|---|---|
| 2016/0102523 | A1* | 4/2016 | Sponchia | E21B 43/10<br>166/250.14 |
| 2018/0100380 | A1* | 4/2018 | El Nekhily | E21B 47/10 |
| 2018/0313179 | A1* | 11/2018 | Kandaswami | E21B 23/01 |

* cited by examiner

SINGLE TRIP LINER HANGER SYSTEM

RELATED PATENT APPLICATIONS

This patent application claims priority from U.S. Provisional Patent Application 62/993,626, filed Mar. 23, 2020.

TECHNICAL FIELD

The present disclosure relates generally to equipment utilized in conjunction with wellbore construction, completion and production operations. More particularly, the embodiments disclosed herein provide a liner hanger system in which multiple operations for installing liners in a wellbore can be achieved in a single trip.

BACKGROUND

When performing petroleum completion operations, a wellbore is drilled and completed to facilitate removal of desired hydrocarbons from a subterranean formation. Once a wellbore is drilled, steel casing or other types of casing may be inserted into the wellbore. Cement may then be pumped into the annulus formed between the casing and the wellbore, in order to prevent migration of fluids or gases in the annulus formed between the casing and the wellbore wall.

Once an upper portion of the wellbore (meaning the portion of the wellbore that is closer to the surface) has been drilled, cemented, and cased, it may be desirable to continue drilling, and to then deploy a liner into a lower portion that typically spans the productive zone of the wellbore. The liner is lowered through the casing that has already been deployed in the upper portion of the wellbore (i.e., it is lowered through the upper cased and cemented portion of the wellbore), and then anchored or suspended from inside the bottom of the casing.

Liners are connected to casing using liner hangers. Liner hangers are typically used to mechanically support an upper end of the liner to be installed, from the lower end of previously installed casing. Additionally, liner hangers may be used to seal the liner against the casing, so that fluid can move through the inside of the liner and the casing, to or from the surface, without leaking into the wellbore at the places where the casing is joined to the liner. Liner hangers also provide a solid bottom upon which to set liner top packers. Liner top packers are used to seal the annulus between the top of the liner hanger and the bottom of the casing in order to prevent formation break down, and to prevent cement, gas and slurry migration during cementing of the lower portion of the wellbore.

Liner hangers utilize mechanical supports (e.g., slips) that expand radially outward into anchoring contact with the casing at desired locations in the upper cased portion. The force required to set the slips into an anchoring engagement, can be generated using a variety of known ways, including hydraulically, mechanically, and explosively. In a separate step, a sealing mechanism in the liner hanger is also set using mechanical, hydraulic, explosive or other forces.

The foregoing operations are typically performed using a running tool, which is used to convey the attached liner and liner hanger into the wellbore. Such a running tool typically comprises various subassemblies that are initially connected to the liner hanger, and then released from the liner hanger when the liner is correctly positioned in the lower portion of the wellbore. The running tool may be used to control when and how a work string is released from the liner hanger, for example, after setting the liner hanger, in an emergency situation, or after an unsuccessful setting of the liner hanger. The running tool is also usually expected to provide for cementing flow therethrough, so that the liner can be cemented to the wellbore. Furthermore, the running tool is typically capable of transmitting torque from the work string to the liner, which is useful for example to remediate sticking of the liner in the wellbore, or to enable the liner to be used as a drill string to further drill the wellbore.

The running tool is interconnected between a work string (e.g., a tubular string made up of drill pipe or other segmented or continuous tubular components) and the liner hanger to form a conventional liner deployment system.

The inner diameter of both the running tool and the work string is restricted, which is problematic. For example, a restricted inner diameter does not allow for a rate of fluid flow that is as high as often desired. A restricted inner diameter inhibits deployment of a range of tools required to deploy frac plugs, setting balls, etc. A restricted inner diameter can also induce chokes in the well during production.

In light of these problems, after the running tool and work string have been used to deploy the liner hanger, and after the running tool has been disengaged from the liner hanger, the running tool and work string are pulled out of the wellbore, which represents a first procedure that must be performed because of the inner diameter restrictions of running tools and work strings. The removal from the wellbore of the running tool and work string in turn creates a need to deploy a tieback casing string that connects the liner top back to surface, which represents a second procedure that must be performed because of the inner diameter restrictions of running tools and work strings. The inner diameter of the tieback casing string is larger than the inner diameter of the work string and running tool, and can be substantially equal to the inner diameter of the liner. This allows the tieback casing string to create an unrestricted passage for fluid, which in turn means there is one substantially constant inner diameter without restrictions that runs from the bottom of the wellbore up to the wellhead. The tieback casing string also has seals at its bottom end that are used to seal it against the liner hanger, using for example a polished bore receptacle on the liner hanger, which provides additional pressure integrity between the casing's inner and outer diameter, from the liner top to the wellhead.

These additional procedures—pulling the work string and running tool out of the wellbore, and then deploying a tieback casing string into the wellbore to connect with the liner hanger—increase cost, time and risk. Additional procedures cost time and money. As discussed later in connection with FIG. 1, disengagement of the running tool from the liner hanger, withdrawal of the liner hanger and work string from the wellbore, and then deployment of the tieback casing string into the wellbore, all add risk. One such risk for example occurs when the running tool cannot be separated from the liner hanger. Such risks might lead to costly emergency contingency actions.

There therefore is a need for a liner hanger system that can be deployed in one trip while avoiding restrictions to the inner diameter. Such a required liner hanger system needs to still be capable of anchoring a liner to casing, and then in a separate operation, of sealing the liner against the casing. The liner hanger system also needs to still provide a solid bottom upon which to set liner top packers.

SUMMARY OF INVENTION

The liner hanger deployment system detailed below negates the need to perform multiple trips to deploy a liner.

The liner hanger deployment system operates by deploying a liner hanger on full bore casing, without using the restricted-diameter running tools and work strings associated with conventional liner hanger deployment systems. The liner hanger deployment system detailed below also provides pressure integrity between the casing's inner and outer diameter from the liner top to the wellhead.

The liner hanger deployment system described in this specification comprises a liner that has a first inner diameter ID1, a liner hanger installed at the uphole end of the liner that includes slips (or another method of anchoring) and a packer and that also has a second inner diameter ID2 substantially similar to said first inner diameter ID1, a tieback casing string that includes a latch for connecting the liner hanger into the tieback casing string and that has a third inner diameter ID3 substantially similar to the liner inner diameter ID1, a packer setting tool wrapped around the tieback casing string above the latch, and a polished bore receptacle arranged between the packer setting tool and the packer. The liner hanger can be connected into the tieback casing string using connection mechanisms besides a latch, such as for example threaded connections that can be engaged with each other.

This liner deployment system's combination of a liner hanger connected into a tieback casing string, enables the liner to be installed in the wellbore by simply lowering the liner deployment system into the wellbore, and by then manipulating the tieback casing string from the surface to, in sequence, engage the slips with the wellbore, optionally decouple the liner hanger from the tieback casing string and set the packer.

Accordingly, this specification is directed to a method for deploying a liner of an internal diameter ID1 into a wellbore having a parent casing, in one trip, comprising: equipping the liner with a liner hanger at its uphole end, the liner hanger comprising one or more slips and a packer; coupling the liner to a tieback casing string using the liner hanger, the tieback casing string having an internal diameter ID2 substantially equal with the ID1; running in the tieback casing string with the liner hanger into the wellbore; setting the liner hanger in the wellbore by anchoring the liner to the parent casing, at a desired location; and setting the packer to seal the liner at the desired location.

As well, a method for deploying, in a wellbore having a parent casing, a liner on a tieback casing string, the liner and the tieback casing string having a substantially equal inner diameter, the method comprising: equipping the tieback casing string with a connection mechanism at its downhole end, and a packer setting tool; equipping the liner with a liner hanger at its uphole end, the liner hanger comprising slips and a packer; coupling the liner hanger to the tieback casing string using the connection mechanism; and installing the liner, the liner hanger and the tieback casing string, into the parent casing, wherein the tieback casing string and the liner hanger system provide an unrestricted inner diameter for fluid flow.

Still further, this specification describes a liner hanger system adapted to be installed in a wellbore using a tieback casing string of an internal diameter ID comprising a first connector, the liner hanger system comprising: a liner with an uphole end, a downhole end and the internal diameter ID; a liner hanger installed at the uphole end of the liner, comprising a second connector for engaging with the first connector in order couple the tieback casing string to the liner hanger; slips provided on the outer wall of the liner hanger, adapted to grip the wall of a parent casing provided in the wellbore; a packer seal arranged around the liner hanger, adapted to be set using a packer setting tool provided on the tieback casing string; and a polished bore receptacle for sealing the first connector against the second connector; wherein the liner hanger and the tieback casing string are coupled to one another, or decoupled from one another, by manipulating the tieback casing string from the surface.

BRIEF DESCRIPTION OF THE DRAWINGS

A detailed description of specific embodiments of the invention briefly described above, follows with reference to the following drawings. The detailed description and the drawings are to be regarded as illustrative in nature and not as restrictive. In particular, the drawings depict only typical embodiments of the invention and are therefore not to be considered limiting of its scope. In the drawings:

FIG. 1A shows how the liner is run-in and FIG. 1B shows the liner hangs from the parent casing.

FIG. 6A shows the packer setting tool not fixedly connected to the tieback casing string during run-in, to avoid setting of the packer. FIG. 6B shows the packer setting tool fixedly connected to the tieback casing string to enable setting of the packer after the liner has been installed.

DETAILED DESCRIPTION

Figure 1B:
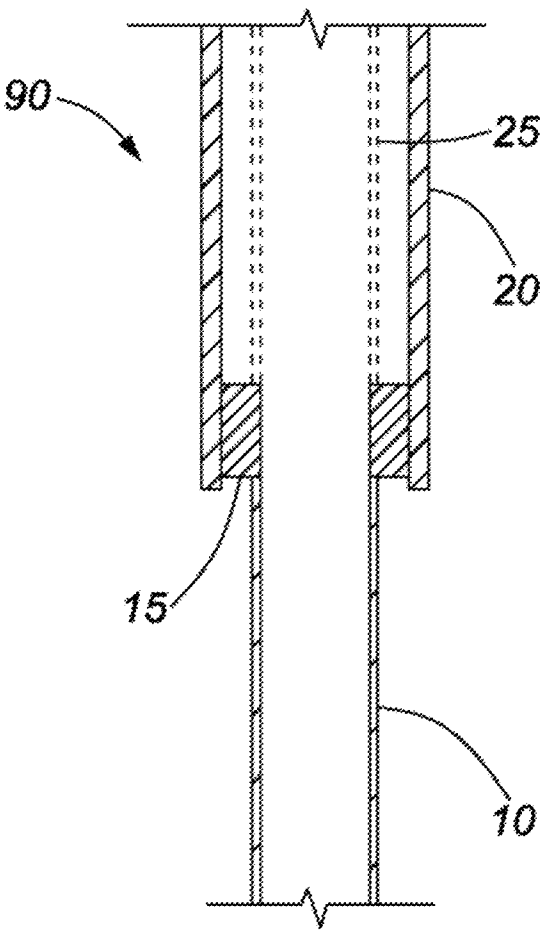
FIG. 1B (PRIOR ART)
FIGS. 1A and 1B (collectively also referred to as FIG. 1) show a sketch of a conventional system for deploying a liner hanger.

It should be noted that terms "upper", "back", "rear", or "uphole" are used to refer to a feature on or closer to the surface side (upwell side) relative to a corresponding feature that is farther from the surface side, which farther feature is denoted by the terms "lower", "forward", "front" or "downhole". For example, an "upper" end of a tubular generally refers to the feature relatively closer to the surface than a corresponding "lower" end. A feature that may be referred to as an "upper" feature relative to a "lower" feature even if the features are vertically aligned may occur, for example, in a horizontal well. Similarly, the terms "uphole", "up", "downhole" and "down" refer to the relative position or movement of various tools or objects, features, with respect to the wellhead.

It is to be understood that variants of the embodiments described and illustrated in this specification will become readily apparent to those skilled in the art.

FIG. 1 illustrates a conventional liner deployment system 90 shown deployed inside casing (also referred to as parent casing) 20. The conventional liner deployment system 90 comprises a work string 1, a running tool 5, a liner 10, a liner hanger 15 (here, illustrated in its set position and not in its run-in position), and a tieback casing string 25. The liner 10 is to be installed in the wellbore. The liner 10 is to be anchored to the casing 20 through the liner hanger 15. The liner 10 is connected at its upper end to the liner hanger 15. The running tool 5 is operated from the surface using the work string 1. In general, the liner 10 is run into the wellbore on the running tool 5 with the liner hanger 15 coupled to the top of the liner 10. The ID of the work string 1 and the ID of the running tool 5 are restricted as noted in the Background discussion regarding conventional liner deployment systems. The IDs of the tieback casing string 25 and the ID of the liner 10 are substantially equal and significantly larger than IDs of the work string 1 and running tool 5.

Once the running tool 5 delivers the liner 10 and liner hanger 15 to the desired depth, slips (not illustrated) of the liner hanger 15 are set resulting in the liner hanger becoming anchored to the parent casing 20. Afterwards a liner top packer (not illustrated), hereinafter simply referred to as a "packer," is set to seal the liner hanger 15, and with it the liner 10, into the parent casing 20. Cement may be placed around the liner 10 before the packer is set.

With the liner hanger 15 set, the restricted inner diameter work string 1 and running tool 5, are disengaged from the liner hanger 15, and pulled out of the wellbore. As mentioned in the Background discussion regarding conventional liner deployment systems, this operation adds time, money and risk to the operation of the conventional system of FIG. 1. For example, with the conventional liner deployment systems 90, the running tool 5 may not be separated from the liner hanger 15 and pulled back out without great effort, requiring remedial emergency contingency actions.

Figure 1A:
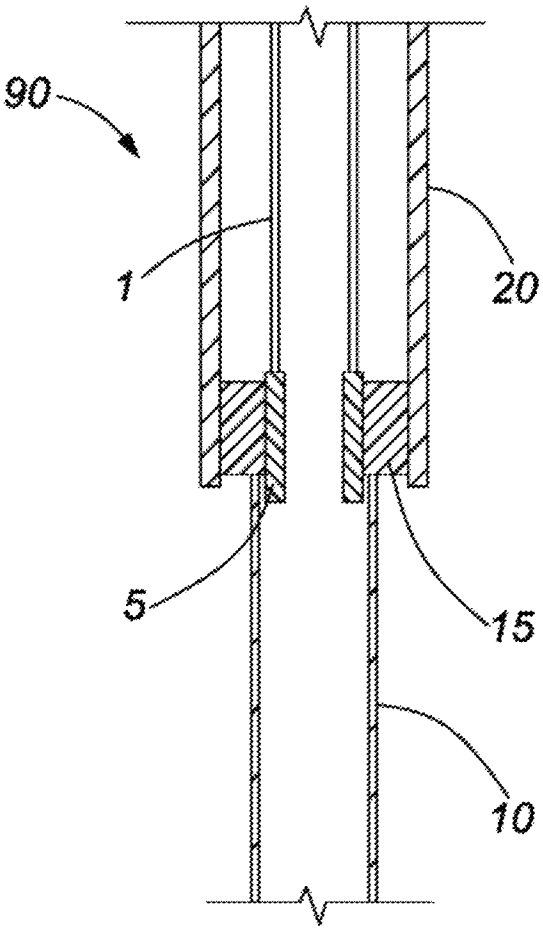
FIG. 1A (PRIOR ART)

FIG. 1A shows placement of liner 10 in the wellbore using the work string 1; the liner is attached to the parent casing using the liner hanger 15. FIG. 1B shows installation of the tieback string 25. At the bottom of the tieback casing string 25 is a seal assembly (not shown on FIG. 1) that uses a polished bore receptacle (not shown on FIG. 1) to connect to the liner hanger 15 and by extension the liner 10, in a fluid-tight and pressure-tight manner. With the conventional liner deployment system 90 of FIGS. 1A and 1B, an extra trip is required to deploy the tieback casing string 25 once the work string 1 and running tool 5 have been removed, which also adds cost, risk and time.

Figure 2:
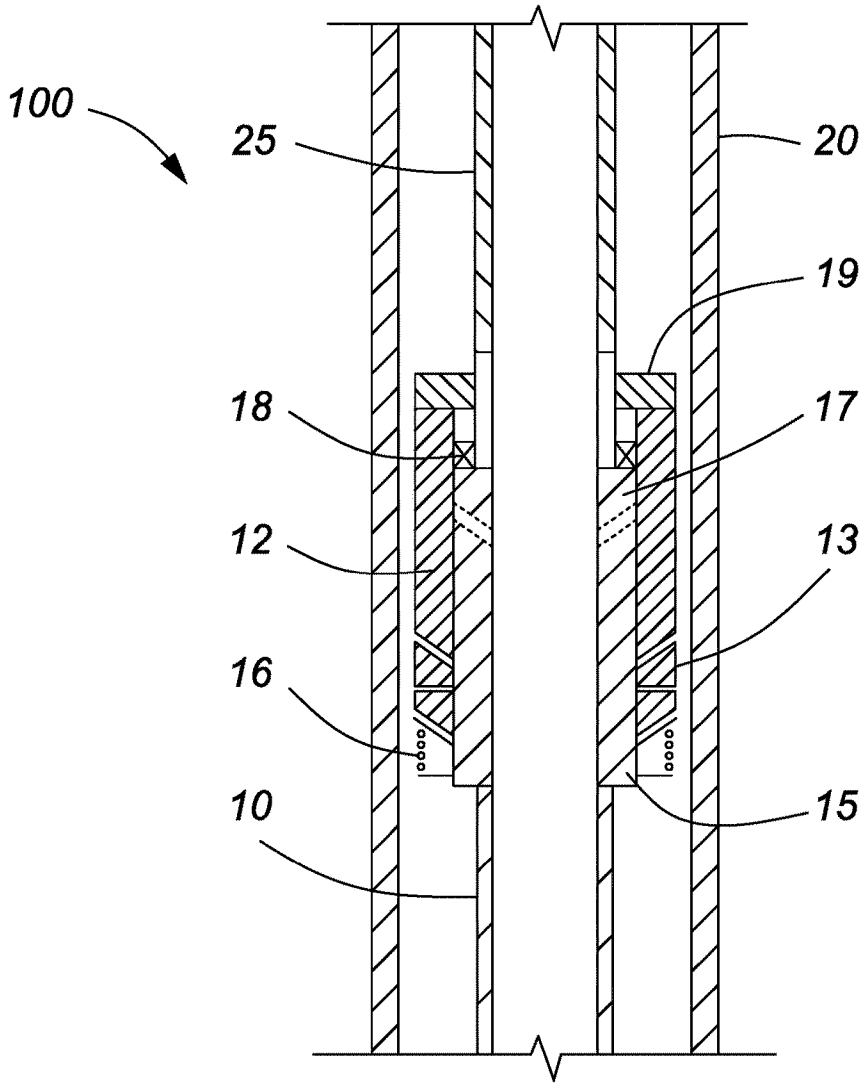
FIG. 2 is a sketch of an embodiment of the liner hanger deployment system described in this specification and claimed herein.

FIG. 2 illustrates an embodiment of the liner hanger deployment system 100, which is the object of this specification and an embodiment of the invention claimed herein. A liner hanger deployment system 100 is shown deployed inside casing (also referred to as parent casing) 20. The liner hanger deployment system 100 comprises a liner 10, a liner hanger 15 (illustrated in its run-in position), and a tieback casing string 25 connected to the liner hanger 15. The liner hanger 15 comprises slips 16, seals 18 and a packer 13. The tieback casing string 25 comprises a latch 17 and a packer setting tool 19. A polished bore receptacle (PBR) 12 is also provided for accepting and coupling the liner hanger 15 and the latch 17 together. More specifically, latch 17, or another connecting mechanism such a threaded connectors, are used to connect the tieback casing string 25 to the liner hanger 15. Seals 18 provide fluid and pressure control by sealing the coupling between the latch 17 and the liner hanger 15 inside of the PBR 12.

The liner hanger deployment system 100 is run into the wellbore to the desired depth, at which time the slips 16 on the liner hanger 15 are set into the parent casing 20. Then, cement may be placed between the liner 10 and the lower portion of the wellbore. The packer setting tool 19, provided uphole from the PBR 12 at the downhole end of the tieback casing string 25, sets the packer seal 13 of the liner hanger 15 after the liner hanger 10 is secured into the wellbore using slips 16.

Importantly, the running tool 5 and work string 1 of conventional liner deployment system 90 have been excluded from liner hanger deployment system 100. This is achieved by running in the liner 10 and liner hanger 15 into the wellbore, using the tieback casing string 25 connected to the liner hanger 15, as described above. Doing so removes from the liner hanger deployment system 100 components having a restricted ID, which in turn removes both (i) the need for an additional trip to remove the running tool 5 and work string 1 of conventional liner deployment system 90, and (ii) the need for another additional trip to deploy the tieback casing string 25 into the conventional liner deployment system 90 after the running tool 5 and work string 1 have been removed.

Running-In of the Liner Hanger Deployment System

The liner hanger deployment system 100 is described next in further detail in conjunction with the method of installing the liner 10 into the wellbore.

Figure 3:
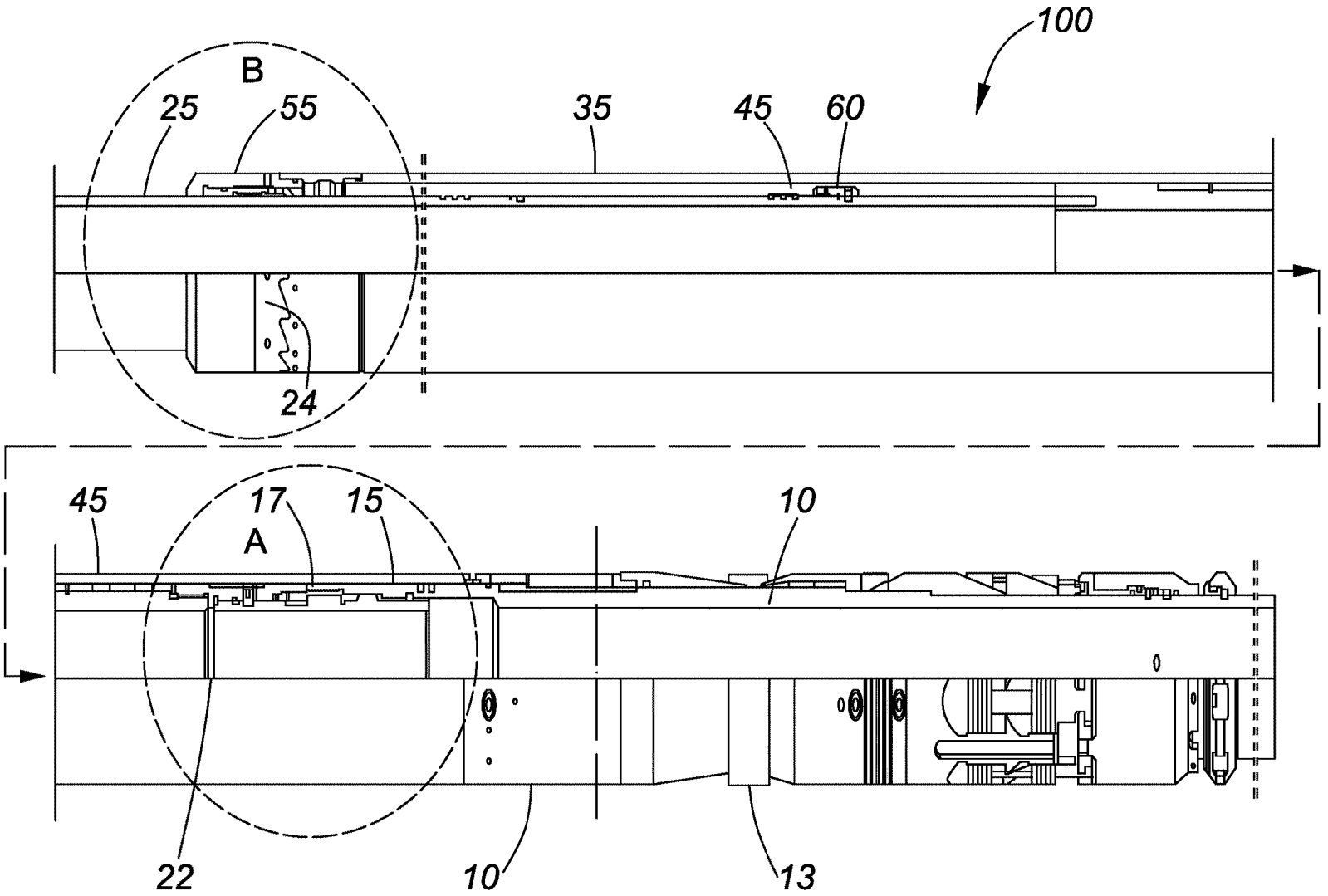
FIG. 3 illustrates the liner hanger deployment system in further detail.

FIG. 3 illustrates the tieback casing string 25 tied into the liner hanger 15, with latch 17 provided at the lower end of the tieback casing string 25 and proximate to the upper end of the liner hanger 15. The tieback casing string 25 also has at least seal assembly 45 that are used to seal it against the liner hanger 15, which provides additional pressure integrity.

Figure 4A:
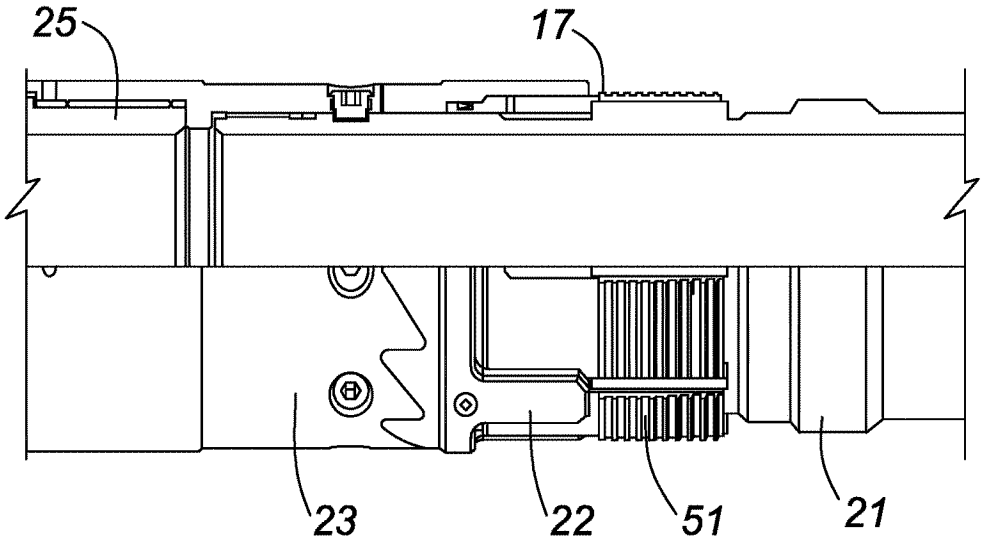
FIGS. 4A and 4B (collectively also referred to as FIG. 4) show the latch at the bottom of the tieback casing string (FIG. 4A), and the mechanism by which the latch connects to the liner hanger (FIG. 4B).

The portion of FIG. 3 delimited in the dotted circle denoted with "A" is described next in connection with FIGS. 4 and 5. As indicated above, the liner 10 is attached to the casing 20 using the liner hanger 15 as seen for example in FIG. 4A. The latch 17 and liner hanger 15 are coupled as illustrated in FIG. 4A when the liner is run-in to the desired depth. During run-in, a torque ring 22 allows for rotation and compression, to keep the liner 10 connected to the tieback casing string 25 through the liner hanger 15 as a compression force is applied to the tieback casing string 25 and the liner hanger 15. In the example described herein, a right-hand rotation of casing 25 is envisaged to effect attachment between the liner hanger 15/liner 10, and the tieback casing string 25. Embodiments using a left-hand rotation can also be used.

Figure 4B:
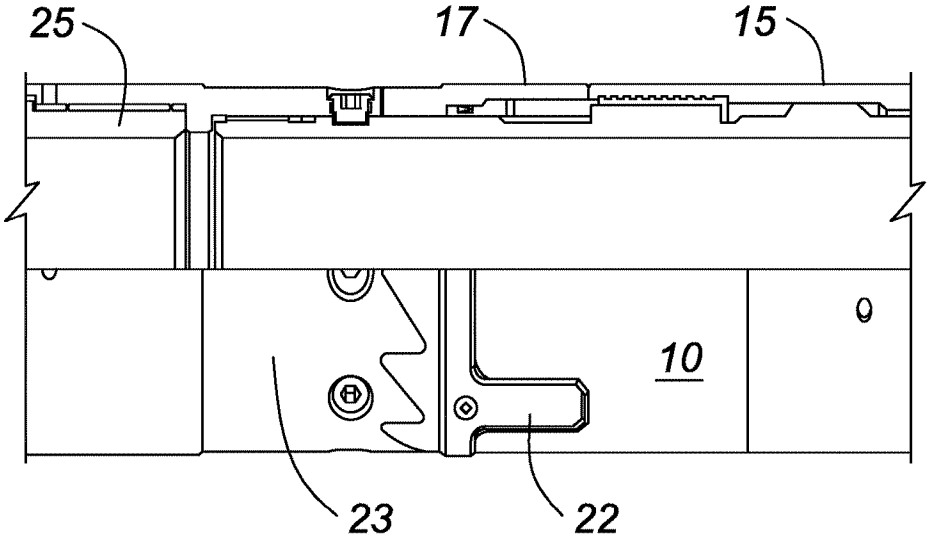
Figure 5A:
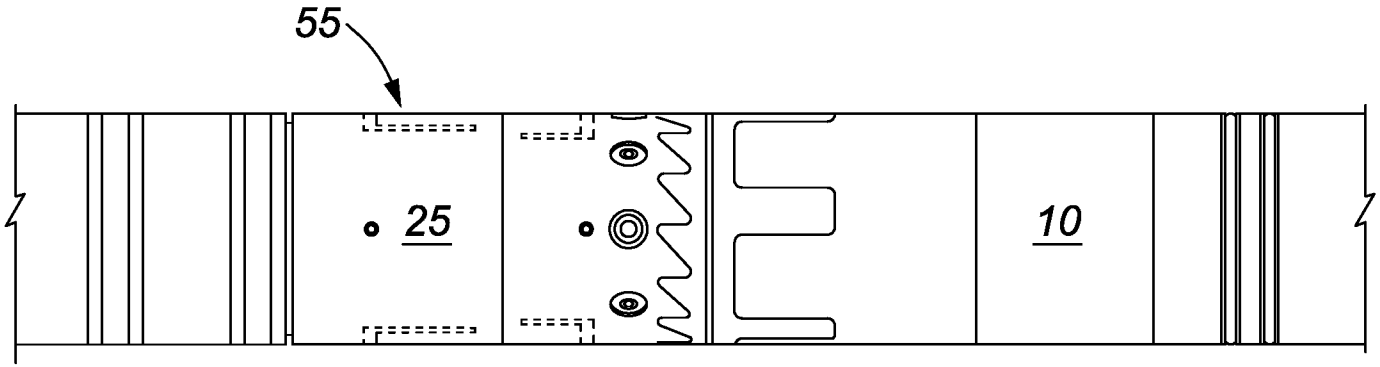
FIGS. 5A and 5B (collectively also referred to as FIG. 5) illustrate the liner hanger and the tieback casing string in an engaged state (FIG. 5A) and a decoupled state (FIG. 5B).

Application of right-hand rotation to the tieback casing string 25 while the liner 10 is being run-in the wellbore, through the torque ring 22, as shown in FIGS. 4 to 6 in further detail, transmits torque from the tieback casing string 25, through the liner hanger 15, to the liner 10, as seen in FIGS. 4B and 5A.

Figure 5B:
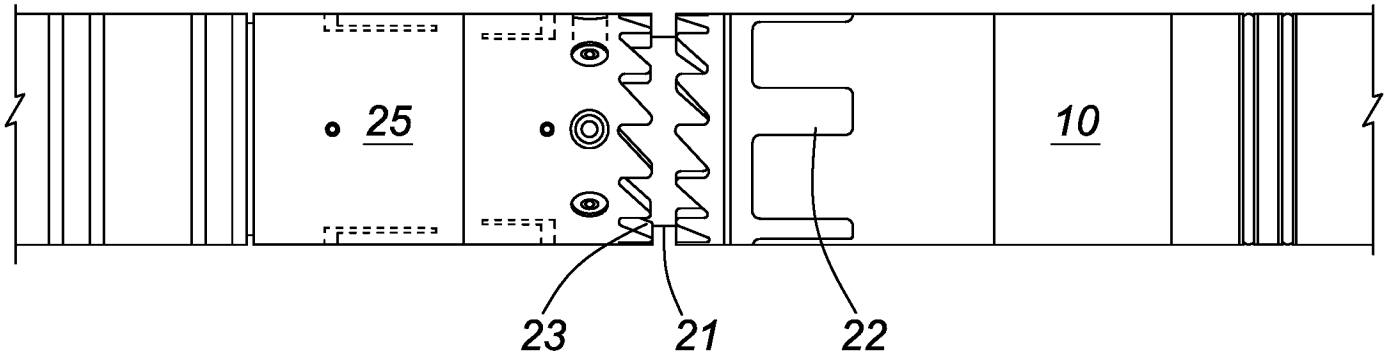

FIGS. 4A and 4B show the latch at the bottom of the tieback casing string (FIG. 4A), and the mechanism by which the latch connects to the liner hanger (FIG. 4B) while FIGS. 5A and 5B illustrate the liner hanger and the tieback casing string in an engaged state (FIG. 5A) and a decoupled state (FIG. 5B).

Putting the tieback casing string 25 into tension (i.e., applying a tension force to the tieback casing string 25 and the liner hanger 15), disengages the torque ring 22 from the crossover 23 as shown in FIG. 5B. A, right hand rotation through the tieback casing string 25 transmits torque from the muleshoe 21 to the latch 17. Continued right hand rotation in this configuration while in tension, will unthread the latch 17 from the liner hanger 15, fully decoupling the tieback casing string 25 from the liner hanger 15 and liner 10 as seen in FIG. 5B.

Setting the Liner Hanger System

With the liner 10 at the desired depth, the liner hanger's slips 16 are set into the parent casing 20. Fluid pressure is introduced from surface into the tieback casing string 25 which causes the slips 16 to set at a threshold pressure. Alternatively, the slips may be set mechanically. After setting slips 16, one may install cement around the outside of the liner 10. The tieback casing string 25 can either remain latched to the liner hanger 15 or it can be decoupled therefrom.

Setting the Liner Hanger's Packer Seal

Figure 6A:
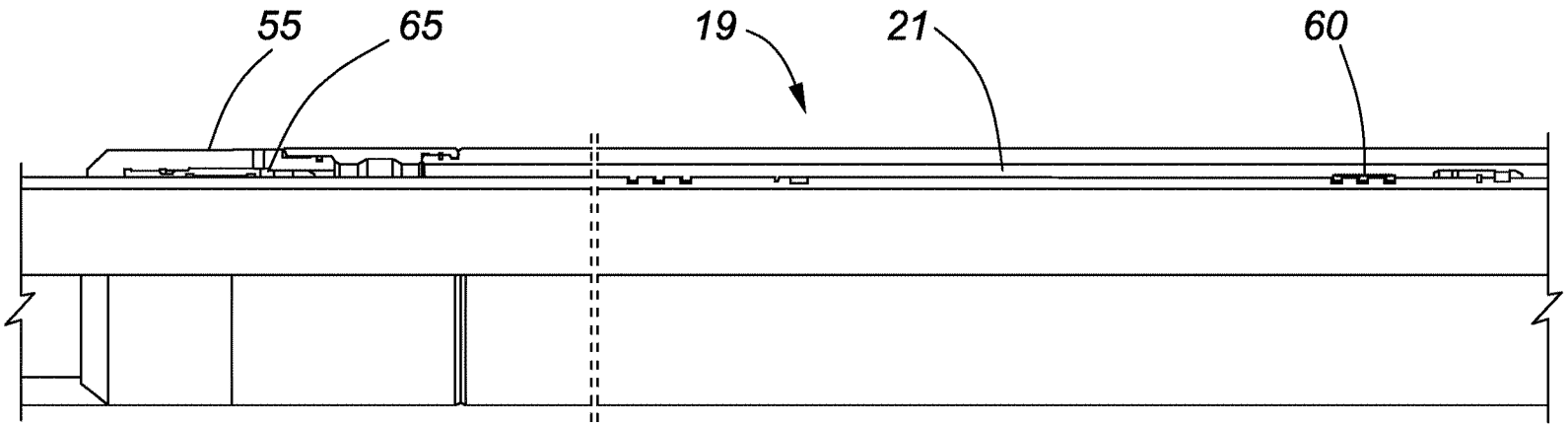
FIGS. 6A-6B (collectively also referred to as FIG. 6) show operation of the packer setting tool.

FIG. 6A shows the configuration of the packer setting tool's components during the run-in stage. The packer setting tool 19 comprises a torque junk sub 55, a setting ring 65, a lock ring 60, and a stop ring 62.

The torque junk sub 55 and the setting ring 65 are attached to the top of the polished bore receptacle 12. As seen in FIG. 6A, at first, the lock ring 60 is located at a longitudinal distance away from the setting ring 65. This prevents the packer setting tool 13 from being prematurely set prior to the desired time.

Figure 6B:
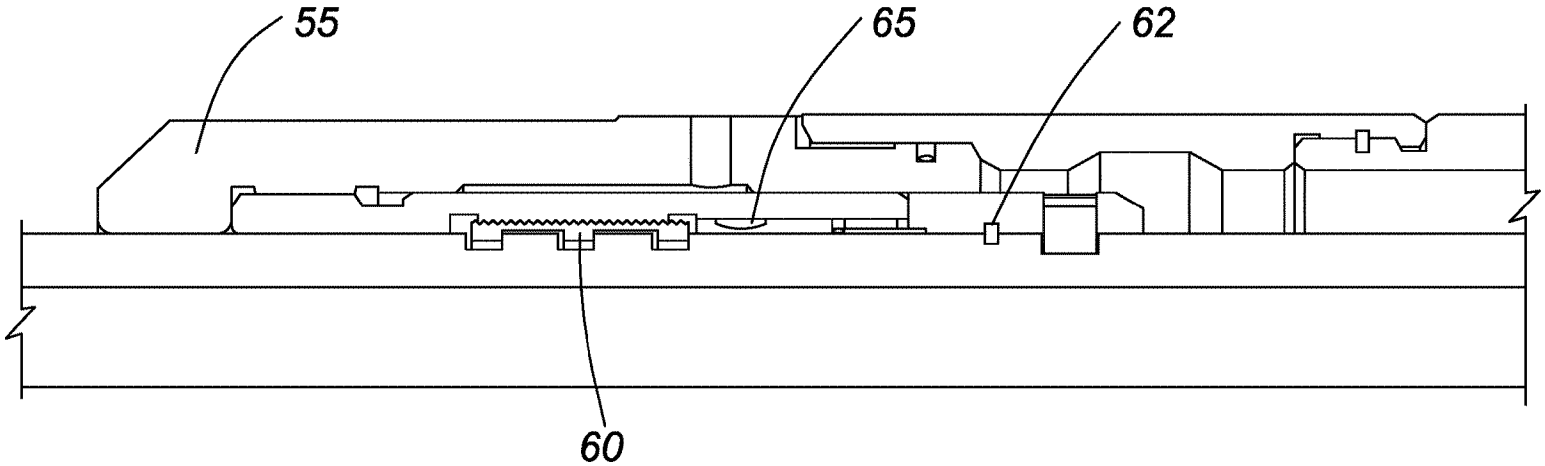

To set the packer 13 using manipulation of the tieback casing string, the tieback casing string 25 is first decoupled from the liner hanger 15, as shown in FIG. 5B as described in "Running-In of the Liner Hanger Deployment System" above. By pulling the tieback casing string 25 uphole a distance (for example between 2-4 feet of pick-up), the lock ring 60 will engage with the setting ring 65 as shown in FIG. 6B. The torque junk sub 55, the setting ring 55, the lock ring 60 and the stop ring 62 would then be all tied together, as shown in FIG. 6B Downward weight is then applied from surface to the tieback casing string 25, which transmits load through the packer setting tool 19, which in turn transmits load through the polished bore receptacle 12 and sets the packer 13 of the liner hanger 15. The packer 13 may also be set hydraulically, or electronically, in which case it may not be necessary to decouple the tieback casing string 25 from the liner hanger 15 as shown in FIG. 5B, to set the packer 13 and otherwise follow the procedure described earlier in this paragraph.

Following the setting of the packer 13, the packer setting tool 19 can either be decoupled, which would allow the latch 17 to be re-engaged with the liner hanger 15 if desired, or the packer setting tool 19 can be left fully engaged and the tieback casing string 25 and the seals 18 of the PBR 12 will be free to traverse up and down inside of the polished bore receptacle 12.

To decouple the packer setting tool 19, right-hand rotation is applied to the tieback casing string 25. That rotation is transmitted through the stop ring 62, which rotates the setting ring 65 through a torque locked engagement. The torque junk sub 55, which is rotationally coupled with the polished bore receptacle 12, does not experience the same rotation from the tieback casing string 25. This results in the setting ring 65 decoupling from the torque junk sub 55. With these components decoupled, the tieback casing string 25 is free to move independently of the torque junk sub 55, the polished bore receptacle 12, and the liner hanger 15.

If desired, the decoupled tieback casing string 25 can be pulled from the wellbore at any time, leaving the liner hanger 15, PBR 12, and liner 10 in place.

Figure 7A:
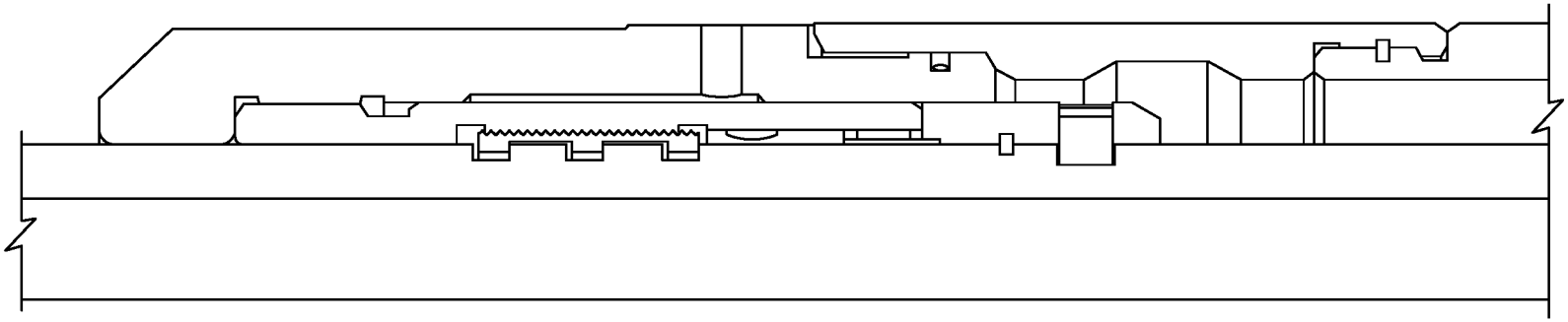
FIGS. 7A and 7B illustrate how the packing setting tool can be disengaged from the packer after the packer has been set, to allow the tieback casing string's latch to be re-engaged with the liner hanger.
Figure 7B:
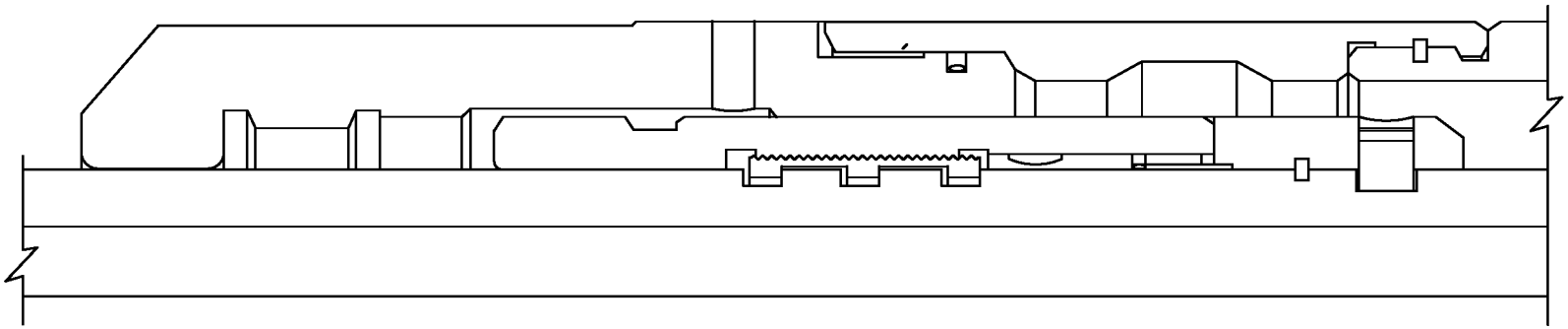

Also seen in FIG. 7A, when the packing setting tool is picked up, the lock ring engages with the packer tool. Now any set down weight will set the packer. FIG. 7B shows how to disengage to tool. To this end, the tool is rotated to the right, which will unthread the top and bottom component.

The invention claimed is:

1. A method for deploying a liner having a first internal diameter (ID1) into a wellbore having a parent casing, comprising:

equipping the liner with a liner hanger at its uphole end, the liner hanger comprising one or more slips and a packer, said liner hanger also having a second internal diameter (ID2) substantially equal to the first internal diameter (ID1);

coupling the liner to a tieback casing string using the liner hanger, the tieback casing string having a third internal diameter (ID3) substantially equal with the first internal diameter (ID1) such that the liner hanger provides a substantially unrestricted passage for fluid from the tieback casing string to the liner;

running in the tieback casing string with the liner hanger into the wellbore; setting the liner hanger in the wellbore by anchoring the liner to the parent casing, at a desired location; and setting the packer to seal the liner at the desired location.

2. The method of claim 1 further comprising latching the tieback casing string back into the liner hanger through manipulation of the tieback casing string from surface.

3. The method of claim 2 further comprising unlatching the tieback casing string from the liner hanger through manipulation of the tieback string from surface.

4. The method of claim 1 further comprising cementing the outside of the liner.

5. The method of claim 1, wherein anchoring the liner to the parent casing at the desired location comprises engaging the slips provided on the liner hanger with the parent casing.

6. The method of claim 1 wherein the tieback casing string comprises a latch, and wherein coupling the liner to the tieback casing string comprises connecting the liner hanger to the tieback casing string using the latch.

7. The method of claim 1, wherein the tieback casing string comprises a packer setting tool, and setting the packer is performed by activating the packer setting tool.

8. A method for deploying, in a wellbore having a parent casing, a liner on a tieback casing string, the liner and the tieback casing string having a substantially equal inner diameter, the method comprising:

equipping the tieback casing string with a connection mechanism at its downhole end, and a packer setting tool;

equipping the liner with a liner hanger at its uphole end, the liner hanger comprising slips and a packer to form a liner hanger system, the liner hanger having an inner diameter substantially equal to the inner diameters of the liner and the tieback casing string;

coupling the liner hanger to the tieback casing string using the connection mechanism; and installing the liner, the liner hanger and the tieback casing string, into the parent casing, wherein the tieback casing string and the liner hanger system provide an unrestricted inner diameter for fluid flow.

9. The method of claim 8 wherein the connection mechanism is a latch.

10. The method of claim 8 wherein installing the liner, the liner hanger and the tieback casing string into the wellbore further comprises:

running-in the liner, the liner hanger and the tieback casing string to a desired location in the wellbore; and performing either of the following steps: (1) manipulating the tieback casing string from the surface to set the slips on the liner hanger into the parent casing; or (2) hydraulically setting the slips into the parent casing.

11. The method of claim 10, wherein running-in the liner, the liner hanger and the tieback casing string, comprises rotating the tieback casing string from the surface in a first direction with a compression force applied to the tieback casing string and the liner hanger.

12. The method of claim 10, further comprising decoupling the liner hanger from the tieback casing string by rotating the tieback casing string from the surface in a first direction with a tension force applied to the tieback casing string and the liner hanger.

13. The method of claim 8, wherein installing the liner, the liner hanger and the tieback casing string, into the parent casing, comprises setting the packer with the packer setting tool.

14. The method of claim 13, wherein setting the packer comprises:

pulling uphole the tieback casing string a specified distance to activate the packer setting tool; and applying downward weight on the tieback casing string from surface to the packer through the packer setting tool.

15. The method of claim 8, wherein installing the liner, the liner hanger and the tieback casing string into the parent casing, comprises cementing the outside of the liner.

16. A liner hanger system adapted to be installed in a wellbore using a tieback casing string of a first internal diameter (ID1) comprising a first connector, the liner hanger system comprising:

a liner with an uphole end, a downhole end and a second internal diameter (ID2) substantially equal to the first internal diameter (ID1) of the tieback casing string;

a liner hanger installed at the uphole end of the liner, comprising a second connector for engaging with the first connector in order couple the tieback casing string to the liner hanger;

slips provided on the outer wall of the liner hanger, adapted to grip the wall of a parent casing provided in the wellbore;

a packer seal arranged around the liner hanger, adapted to be set using a packer setting tool provided on the tieback casing string;

the liner hanger having a third internal diameter (ID3) substantially equal to the first internal diameter (ID1) and the second internal diameter (ID2); and a polished bore receptacle for sealing the first connector against the second connector;

wherein the liner hanger and the tieback casing string are coupled to one another, or decoupled from one another, by manipulating the tieback casing string from the surface.

17. The liner hanger system of claim 16 wherein a substantially unrestricted inner diameter is provided along the length of the tieback casing string and the length of the liner.

18. The liner hanger system of claim 17 further comprising seals adapted to provide fluid and pressure control by sealing the engagement between the first connector and second connector inside of the polished bore receptacle.

19. The liner hanger system of claim 16 wherein the first connector and second connector comprise parts of a latch system.

* * * * *